US005435563A

United States Patent [19]

Salvatore

[11] Patent Number: 5,435,563

[45] Date of Patent: Jul. 25, 1995

[54] GOLF POSTURING DEVICE

[76] Inventor: Robert Salvatore, 244 Nightingale, Dearborn, Mich. 48128

[21] Appl. No.: 261,834

[22] Filed: Jun. 17, 1994

[51] Int. Cl.[6] ..... A63B 69/36

[52] U.S. Cl. ..... 273/188 R; 128/870

[58] Field of Search ..... 273/187.2, 189 R, 188 R, 273/190 R; 128/870; 434/247

[56] References Cited

U.S. PATENT DOCUMENTS

| | | | |
|---|---|---|---|
| 766,863 | 8/1904 | Adams . | |
| 2,828,737 | 4/1958 | Hale . | |
| 3,331,367 | 7/1967 | Hastings . | |
| 3,346,257 | 10/1967 | Whitney | 273/187.2 X |
| 3,420,230 | 1/1969 | Ballard . | |
| 3,900,199 | 8/1975 | McGonagle . | |
| 4,143,654 | 3/1979 | Sherman . | |
| 4,259,950 | 4/1981 | Klippel . | |
| 4,708,130 | 11/1987 | Grudem . | |
| 5,007,415 | 4/1991 | Marion . | |
| 5,085,437 | 2/1992 | Leitao | 273/189 R X |

*Primary Examiner*—George J. Marlo
*Attorney, Agent, or Firm*—Harness, Dickey & Pierce

[57] ABSTRACT

A selectively adjustable golf posturing device includes two partially overlapping panels forming a longitudinally adjustable support member padded at each of its body engaging ends, and including a plurality of adjustable straps for attaching the support member to the player's body. Preferably the golf posturing device is made from a light weight material such as plastic, with the straps being made from an elastic material and including self-closing tape-type fasteners such as VELCRO which allow for adjustability of the strap about the player's body.

9 Claims, 3 Drawing Sheets

GOLF POSTURING DEVICE

BACKGROUND OF THE INVENTION

1. Field of the Invention

This invention relates generally to the game of golf and apparatuses for improving an individual's ability to play golf, and more particularly, to a novel golf posturing device which prevents the player from slouching at any time during the golf swing, thus allowing for proper upper and lower body movement through the golf ball.

2. Description of Related Art

The game of golf is becoming more and more popular, not only in the United States but in many foreign countries as well. One attractive feature about the game of golf is that almost any individual may participate despite having certain physical handicaps or a lack of coordination which makes it more difficult to compete on a head-to-head basis with others. However, because the game is generally handicapped, those less experienced or less coordinated individuals may still play against more experienced individuals while obtaining the same enjoyment from the game.

Obviously, the objective of the game of golf is to obtain the fewest number of strokes possible during a round. Thus many inventions directed to golf clubs, golf swing training devices, yardage detectors, and stance coordinators, among others, have been developed all with the intention of assisting the golfer in obtaining lower scores.

One such device is disclosed in U.S. Pat. No. 3,900,199 which issued Aug. 19, 1975 to Hugh K. McGonagle, which relates to a golf swing training brace which is attachable to a golfer's lead arm in an effort to force the golfer to maintain the lead arm in a relatively straight position while taking a swing. As correctly noted, most golfers tend to bend their lead arm at or about the moment the golf ball is struck thus preventing the club head from travelling in substantially the same direction as the desired line of flight for the golf ball. As with other golf training apparatuses, the objective is generally to provide the player with the ability to have control over the line of flight of the golf ball.

Still other golf training apparatuses such as the one discussed in U.S. Pat. No. 5, 188,365, which issued Feb. 23, 1993, to Picard relates to a golf swing training harness designed to assist in obtaining a proper swing path. The training harness includes a waist band, two arm bands and a leading leg band all interconnected by an elastic strap which limits the range of motion of the arms and the leading leg of the player during periods of use. One perceived drawback of this invention is that while it conceivably precludes undesired movement of the players arms relative to the legs, it does not compensate for the lack of good posture while swinging the golf club.

Yet another adjustable golf swing training device is disclosed in U.S. Pat. No. 5,188,366, which issued Feb. 23, 1993, to Dorotinsky. The golf swing training device disclosed therein relates to an adjustable belt for encircling the golfer's waist which is rotatable during the golfer's swing, a ground anchoring stake for attaching the training device to the ground and a resilient cord which extends between the ground anchoring stake at the waist belt. The theory here is that by limiting the golfer's ability to move laterally during the swing the golfer will more likely make a proper hip and shoulder turn thus allowing the golfer to better direct the line of flight of the golf ball. Again, the training device disclosed theoretically will assist the player in making a proper hip and shoulder turn. In the absence of a proper posture, this training device will not work to its maximum potential. Still numerous other golf training apparatuses which are not directly attached to the human body are available.

While most golf related inventions which are attachable to the human body deal with mechanisms for precluding undesired movement of an individual's arms or legs, until now, few if any have been directed to maintaining proper posture while swinging the golf club. Perhaps more than any other physiological aspect of a golfer's address of the ball, the golfer's posture affects both how consistently a player swings the golf club and how an individual strikes the golf ball. Typically, bad postures destroy the feel of the motion and the rhythm of a good golf swing. As a player slouches during their swing, various other areas of the body are affected, thus making it virtually impossible to strike the ball in a desirable and consistent manner. One result of this slouching is that players tend to flex too much at the knee which in turn results in excessive weight being generated on the back of the player's heels. In this position, the player's chin tends to bury toward their chest, thus making it difficult to make a full body turn when striking the golf ball. Preferably, the player's body weight will be concentrated more toward the balls of their feet rather than on their heels during the swing, which allows them to adjust from side to side as the player's arms come back during the take away and forward during the follow through. Further, the player's hands tend to be lower, which makes it difficult to fully rotate the arms during the swing. By maintaining a fairly upright posture, the player has the ability to bend at the hips which then allows the player's arm to have room to suspend at the shoulders. This allows for freedom of movement during the entire golf swing, including both the take away and the follow through.

Not only do the better players have good posture, but they tend to do it very consistently. Thus the golf posturing device of the present invention will assist a player in developing a good posture and through what is commonly referred to by knowledgeable golfers as "muscle memory", maintain good posture on a consistent basis after a period of utilizing the present invention, then playing without having the golf posturing device attached.

SUMMARY OF THE INVENTION

The present invention relates to a posturing device for assisting a golfer in obtaining and maintaining good posture during the swing. The invention includes a selectively adjustable support member generally disposable along the player's spinal column between the sacral and cervical portions of the spine. This support member includes under at least one embodiment first and second partially overlapping panels which are adjustable relative to each other to accommodate players of varying heights. The panels are generally made from a lightweight material such as high-strength plastics, for example. At each end of the posturing device, pads are provided which cushion the engagement with the player's lower back along the sacrum and neck along the cervical vertebrae upon attachment.

In addition to the support member, adjustable straps are provided for attaching the posturing device to the player. At least two straps are utilized, one being disposed along the lower end and the other being disposed along the upper end of the support member. Preferably the straps are made from an elastic material which allows them to expand or contract relative to the girth of the individual utilizing the posturing device. The straps also include fasteners disposed at each mating end for maintaining the golf posturing device in an operational position. Typically, the straps project outwardly from the edges of the support member and can be wrapped about the player's torso near the waistline and under the player's arms. Additionally or in the alternative, the uppermost strap may be disposed along the top edge of the panel wherein the strap is bifurcated to attach over the player's shoulders, much like suspenders.

The present invention is therefore primarily concerned with providing a device which assists golfers in obtaining and maintaining proper posture during the golf swing.

The objects of the invention are to provide a posturing device capable of being adjusted to fit substantially all people, including those individuals who are tall, short, thin and wide, as well as both right and left handed players. The golf posturing device allows for complete rotation of the hips and shoulders, range of motion of the arms and legs and ease in attachment and removal. The golf posturing device is simple in design and is readily manufactured at a relatively low cost. Ideally, the golf posturing device will be durable and aesthetically pleasing.

Still other objects and advantages of the present invention will become apparent from reading of the detailed description of the preferred embodiments which make reference to the following set of drawings in which:

DETAILED DESCRIPTION OF THE DRAWINGS

P DETAILED DESCRIPTION OF THE PREFERRED EMBODIMENT

Figure 1:
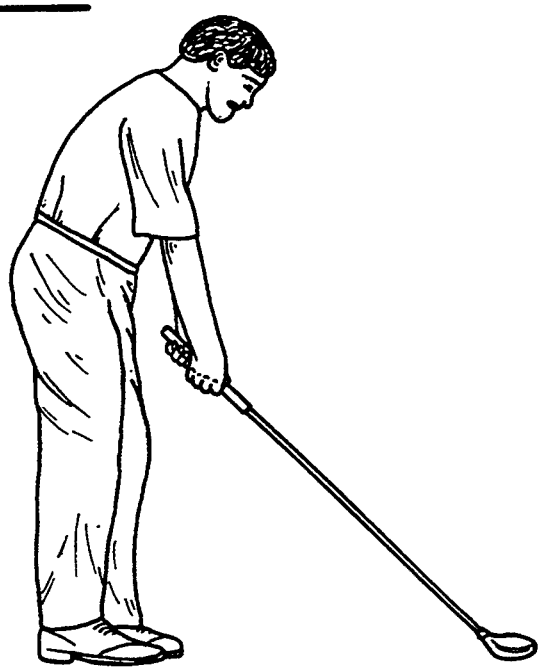
FIG. 1 is a side elevational view of a right-handed golfer shown in a slouched position ready to address the golf ball.
Figure 2:
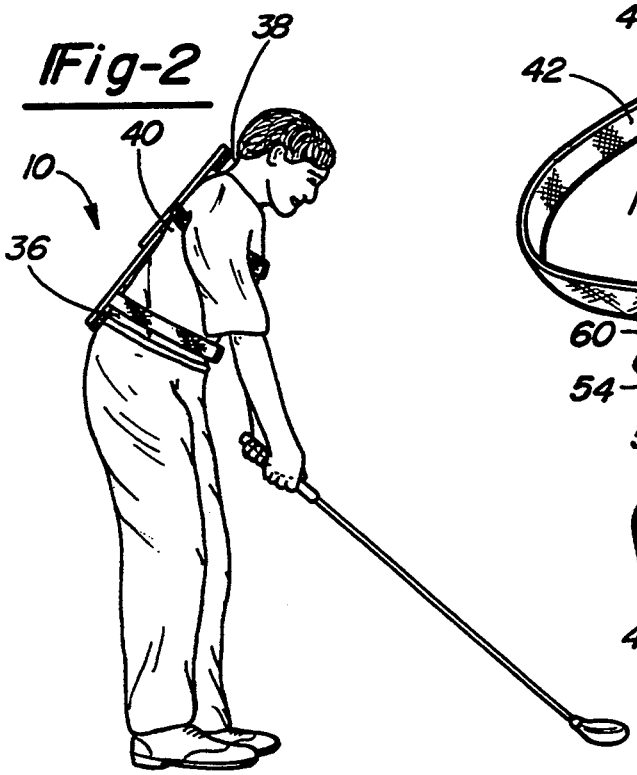
FIG. 2 is a side elevational view of the golfer of FIG. 1 having a golf posturing device of the present invention attached along his back.

Referring to FIG. 1, a side elevational view illustrating a golfer having a substantially slouched back position is illustrated. As noted, in this slouched position the golfer is unable to make a complete body turn through the golf ball which is essential in making proper contact with the ball. Conversely, as illustrated in FIG. 2, the golfer has a golf posturing device 10 attached along the center line of his back, which assists the golfer in developing proper posture during the swing.

Figure 3:
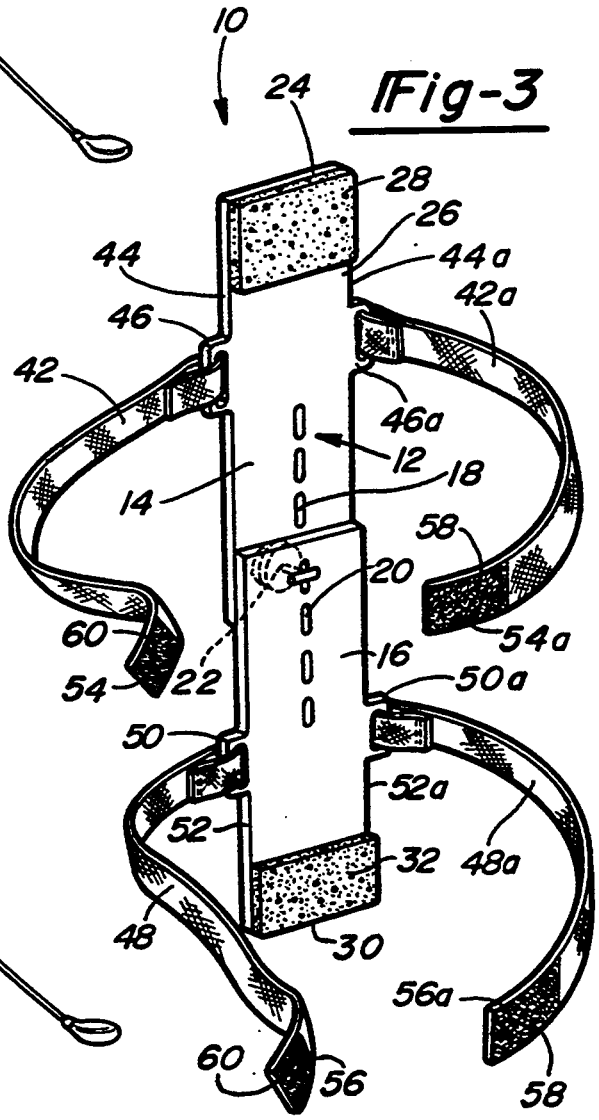
FIG. 3 is a perspective view of a first alternative preferred embodiment of the golf posturing device of the present invention.

With regard to the actual design of the golf posturing device of the present invention, FIG. 3 illustrates a first alternative preferred embodiment of the golf posturing device according to the teachings of the present invention. The golf posturing device 10 includes a support member 12 which can be manufactured using a number of materials including but not limited to, hard rubber, wood, metal and plastic, among others. Most preferably, the support number 12 will be formed from a durable light weight plastic material due to the design flexibility offered by plastics and its relatively low cost. Under the embodiment illustrated with reference to FIG. 3, the support member 12 includes first and second substantially flat, rectangular shaped panels 14 and 16, which are arranged in a partially overlapping manner. The panels typically include elongated sides and shorter ends. The first and second panels 14 and 16 of the embodiment of FIG. 3 are preferably adjustable relative to each other to accommodate golfers of varying heights. First and second panels 14 and 16 are provided with a plurality of complimentary apertures 18 and 20, respectively, for receiving fasteners 22 to lock the panels in the desired position. Among the numerous types of fasteners which are considered useful under the present invention, simple spring loaded pull pin type fasteners tend to work well. Typically, a single fastener extends through a pair of axially aligned apertures, one contained on each panel to lock the panels together. As noted previously, ideally the overall length of the support member 12 when adjusted will be equivalent in distance to the distance between the individual's sacral and cervical vertebrae when the individual is standing in a fully upright position.

Disposed along a first end 24 of the first panel 14 on the inner surface thereof 26, is a sponge like pad 28 which provides the support member with cushioning at the first end. Likewise, the second end 30 of the second panel 16 is provided with a sponge like pad 32 disposed along the inner surface 34 of the second panel. In addition to providing cushioning, the pads 28 and 32 serve as contact points at the lower back 36 and neck 38 as illustrated in FIG. 2 to assure that the support member 12 is fully extended to the desired length. While the pads can be adhered to the panels in a variety of ways, generally they will be adhesive attached.

To attach the golf posturing device 10 to the player's back along the player's midline or spinal column 40, resilient straps are provided proximate to the first and second ends of the support member. A first set of straps 42 and 42A are positioned proximate to the first end 24 of the first panel 14, such that the straps project outwardly along the elongated lateral edges 44 and 44A of the panel. Typically, loops 46 and 46A are provided along the lateral edges 44 and 44A, respectively, for receiving the associated strap in a manner to affix the strap to the support member. As shown, a first end of the strap is inserted through the loop and attached to the strap by sewing or other means as is known. Likewise, a second set of straps 48 and 48A are positioned proximate to the second end 30 of the second panel 16 with the straps being affixed to loops 50 and 50A, respectively, extending from the lateral edges 52 and 52A of the second panel.

The terminal ends 54 and 54A of the first set of straps, and the terminal ends 56 and 56A of the second set of straps, are both provided with fastening means for connecting the respective terminal ends. While various fastening means are contemplated for securing the terminal end portions of the first and second sets of straps to each other about the individual's torso, one preferred means consists of VELCRO® type fasteners. Under this arrangement one associated strap would include a loop receiving pad 58 on the outer surface thereof and the corresponding strap would include an area of hook fasteners 60 disposed on the inner surface thereof such that upon overlapping the terminal ends of the straps they will remain selectively attached as desired. Alternatively, the hook-like fasteners and the loop receiving pad can also be disposed on the opposite straps, in the opposite manner. Essentially with this type of fastener it is desirable that when the two members of the fastener are pressed together in a face-to-face relationship there is substantial engagement of the hooks with the loops requiring a significant effort to ply them apart.

Figure 4:
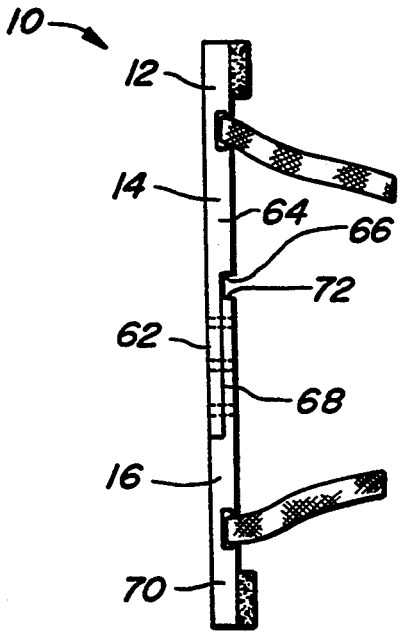
FIG. 4 is a side elevational view of a second alternative preferred embodiment of the present invention.

Referring to FIG. 4, a side elevational view of a second alternative preferred embodiment of the present invention is provided. As the various alternative embodiments of the present invention include numerous, substantially identical elements, it should be understood that like reference numerals will be used for like features. According to the embodiment illustrated with reference of FIG. 4, a support member 12 is again comprised of first and second partially overlapping panels 14 and 16, respectively. However, instead of being relatively flat, the panels 14 and 16 are substantially L-shaped in side view. The first panel 14 includes a relatively thin elongated portion 62 and a wider section 64 with a shelf 66 provided transversely to the elongated portion. Likewise, the second panel 16 also includes a relatively thin elongated portion 68 and a wider base portion 70 including a transversely disposed shelf 72. Ideally, the first and second panels 14 and 16 are identical in size and shape such that a single mold can be used to form either panel.

To assemble the panels, one of the panels is inverted such that the two elongated portions 62 and 64 are disposed in a partially overlapping manner. In this way, the inner surface 26 of the first panel 14 and the inner surface 34 of the second panel 16 of the support member 12 are substantially linear. In all other respects the golf posturing device of FIG. 4 is identical to that of FIG. 3.

Figure 5:
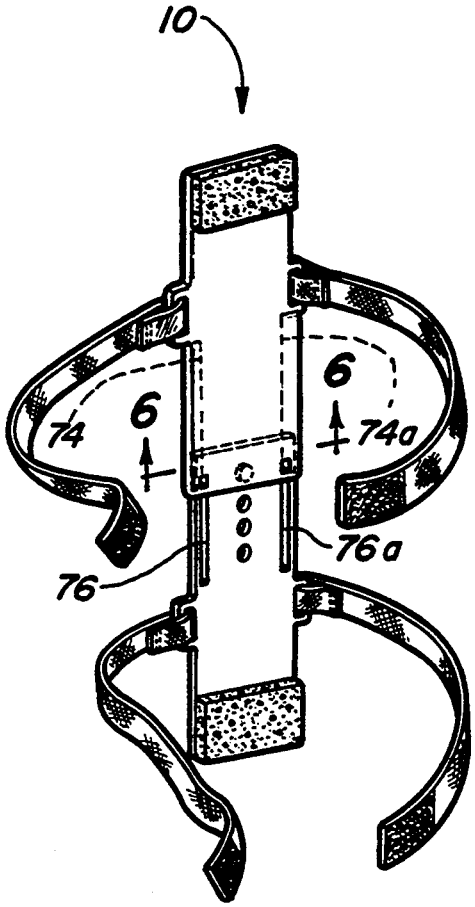
FIG. 5 is a perspective view of a third alternative preferred embodiment of the golf posturing device of the present invention.
Figure 6:
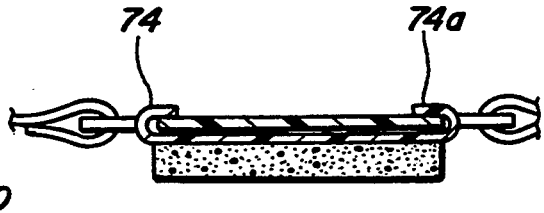
FIG. 6 is a top view of the golf posturing device of FIG. 5.

Referring to FIGS. 5 and 6, a third alternative preferred embodiment of the golf posturing device of the present invention is provided. Under this embodiment the first panel 14 is provided with substantially C-shaped flanges 74 and 74A extending rearwardly along each of the lateral edges 44 and 44A retaining the second panel 16. Slots 76 and 76A may optionally be provided along the second panel 16 for receiving tabs (not shown) extending from the first panel for assistance in guiding the panels when they are extended. As with the embodiments illustrated in FIGS. 3 and 4 fastening means such as spring loaded pins are utilized to retain the respective positions of the first and second panels.

Figure 7:
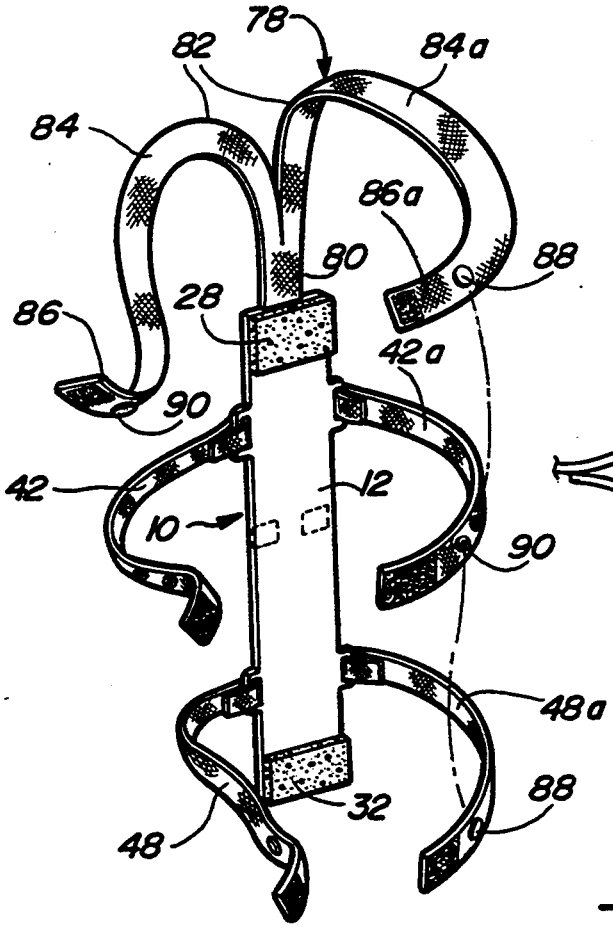
FIG. 7 is a perspective view of a fourth alternative preferred embodiment of the golf posturing device of the present invention.

Referring to FIG. 7, a perspective view of a fourth alternative preferred embodiment of the present invention is provided. According to this embodiment the support member 12A is a unitary piece manufactured for an individual having a predetermined height. While the embodiment illustrated in FIG. 7 is intended to illustrate that the support member can be made of a unitary piece, it should be readily recognized by those skilled in the art that the support member 12 may also be constructed of first and second panels which are adjustable relative to each other.

In addition to the first and second sets of straps 42 and 42A, and 48 and 48A, extending from the lateral edges of the support member as discussed with reference to FIGS. 3 through 6, a third adjustable strap 78 which extends from the first end 24 of the support member 12 is provided. Preferably, the third strap 78 includes a base portion 80 which extends from the support member 12 and a bifurcated portion 82 extending from the base portion 80 to provide first and second strap portions 84 and 84A to be positioned over each shoulder of the individual utilizing the golf posturing device 10. Again, this third strap 78 is preferably made from a resilient material such as elastic to accommodate individuals of various stature.

Attachment of the golf posturing device illustrated in FIG. 7 is accomplished by positioning the support member 12 along the center line of the individuals back such that the pads 28 and 32 are adjacent the sacral and cervical vertebrae as shown in FIG. 2. The terminal ends of the first and second sets of adjustable straps are then connected in the manner as previously described. The third strap 78 is positioned such that the first and second strap portions 84 and 84A are pulled over each respective shoulder, with the terminal ends 86 and 86A of the third strap 78 being attached to the outer surface of the first set of straps, the outer surface of the second set of straps or both first and second sets of straps. In addition to the possibility of utilizing VELCRO®fastening means to connect the third strap 78 to the first, second or both first and second sets of straps, snap members 88 and snap retainers 90 can be reversibly utilized. Due to the resiliency of the strap material, the third strap 78 can be stretched for a first connection to the lower second set of straps as well as a second connection to the upper first set of straps.

Figure 8:
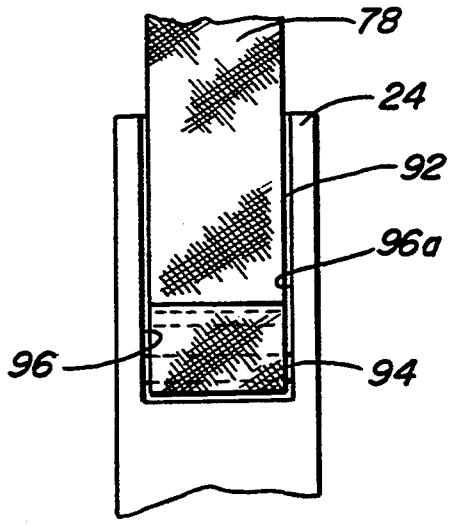
FIG. 8 is a broken-away rear elevational view illustrating the attachment of a should strap according to the teachings of the present invention.

Referring to FIG. 8, means for attaching the third strap 78 to the support member 12 is illustrated. Preferably the first end 24 of the support member 12 includes a recessed area 92 including a post member 94 extending between two walls 96 and 96A. An end of the third strap 78 is looped over the post member 4 and attached back over the strap 78 as with the first and second sets of straps.

Figure 9:
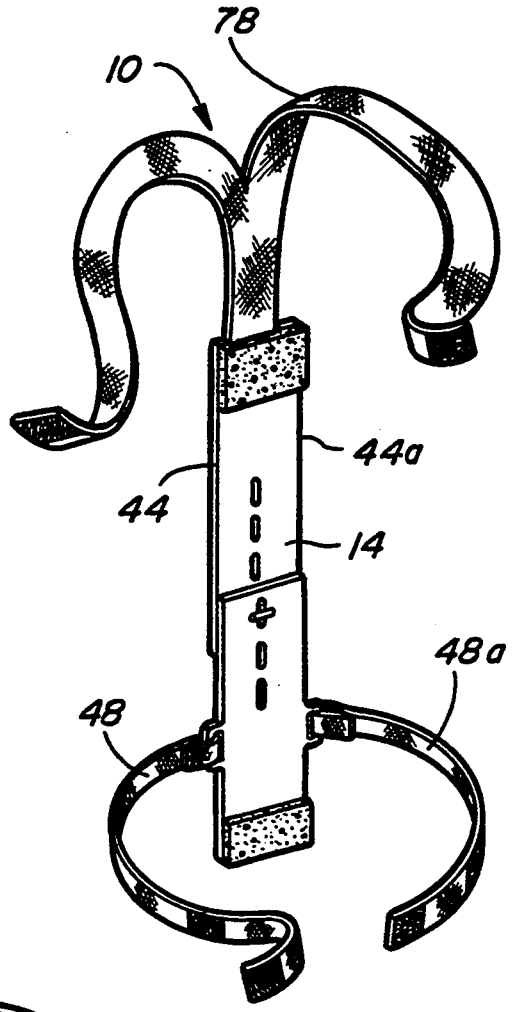
FIG. 9 is a perspective view of a fifth alternative embodiment of the golf posturing device of the present invention.

Referring to FIG. 9, a perspective view of another alternative preferred embodiment of the present invention is provided. Under this embodiment the first set of straps which normally extend from the elongated lateral edges 44 and 44A of the first panel 14 have been eliminated. Herein the second set of straps 48 and 48A extending from the lateral edges 52 and 52A of the second panel 16 are attached about the individual's torso and the third strap 78 as described in FIG. 7 is positioned over the individuals shoulders. The third strap 78 is then attached to the second set of straps 48 and 48A using VELCRO®, snaps or another similar fastener arrangement as previously described.

Figure 10:
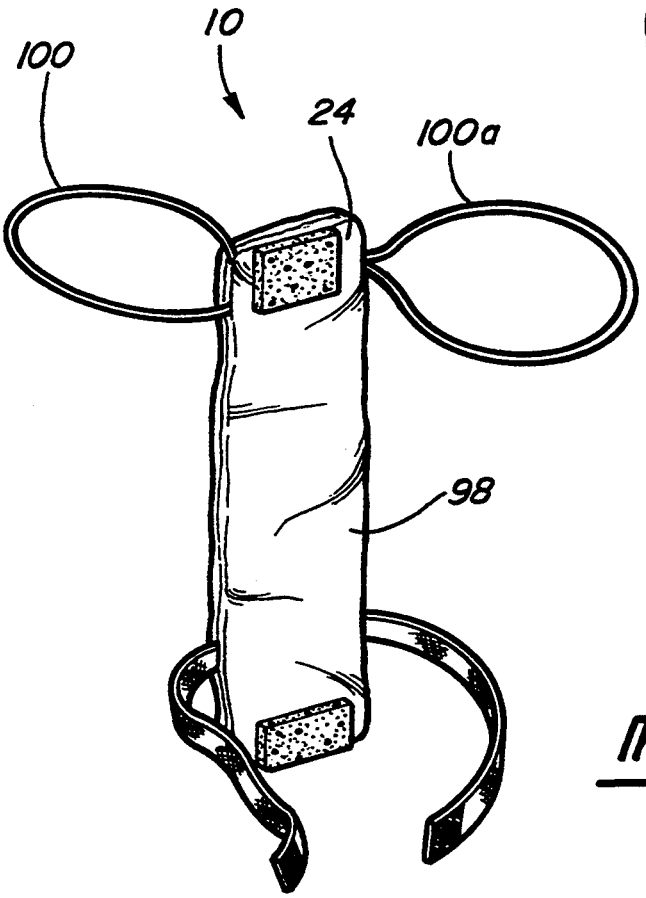
FIG. 10 is a perspective view illustrating a golf posturing device of the present invention including a padded decorative cover.

Referring to FIG. 10 a perspective view of another alternative preferred embodiment of the present invention is provided. According to FIG. 10 the support member (not shown) is contained within a decorative covering 98 made from a variety of different materials including but not limited to cloth, vinyl, and leather, among others. An added feature of the embodiment illustrated in FIG. 10 is that the first set of straps are replaced by a pair of adjustable shoulder loops 100 and 100A, respectively, extending from the lateral side edges of the posturing device 10 along the first end 24. Hereto, it is desirable that the shoulder loops 100 and 100A are made from an elastic like material to accommodate individuals of varying size.

The operational aspects of the present invention will now be discussed in greater detail. Initially, the individual utilizing the golf posturing device 10 adjusts the first and second panels 14 and 16 such that the overall length of the support member 12 is substantially equivalent to the distance between their sacral and cervical vertebrae when the individual is standing upright. Under those embodiments which include a non-adjustable unitary support, the individual chooses one which is equivalent in length to the distance between their sacral and their cervical.

Once the support member 12 is adjusted for length, if necessary, the individual aligns the support member 12 along the center line 40 of their back such that the first end 24 of the support member 12 is positioned along the golfers neck 38 and the second end 30 of the support member 12 is positioned along the lower back 36. Once the support member is properly aligned, the second set of straps 48 and 48A are attached about the individuals waist line and adjusted for size. Then the first set of straps 42 and 42A are positioned around the individuals torso and the terminal ends are connected in the aforementioned partially overlapping manner.

Similarly, under the embodiments including the shoulder straps in the form of closed loops 78 the individuals arms are inserted through each strap. Due to the elastic nature of the straps the support member naturally becomes positioned contiguously against the individuals back upon attachment. Likewise, under the embodiments utilizing an over the shoulder type strap, the strap is pulled over the shoulders with each of the bifurcated strap portions 84 and 84A being disposed over one shoulder. The terminal ends 86 and 86A of the bifurcated straps are also attached to either the first or second set of straps or both via the fastening means as previously set forth.

The upper and lower pads 28 and 32, respectively, generally contact the individuals neck 38 and lower back 36 along the cervical and sacral vertebrae, respectively, to ensure that the individual's posture is substantially upright. In this manner the individual is able to make a complete shoulder and body turn through both the back swing and the follow through which allows them to make solid contact with the golf ball.

While various aspects of the present invention have been set forth above, it should be understood by those skilled in the art that the golf posturing device of the present invention is susceptible to variation, modification and change within the intended scope of the present invention. For example, the contour of the support member may be altered such that it more naturally follows the contour of an individuals back with subtle curvation along the lower back and upper shoulders. Other potential modifications include disposing a sponge-like pad along the entire length of the inner surface of the support member to increase comfort and providing the decorative covering with display means for various messages or designs.

Thus, while it will be apparent that the preferred embodiments of the invention disclosed are well calculated to provide the advantages stated above, it will be appreciated that the invention is susceptible to modification, variation and change without departing from the proper scope and fair meaning of the subjoined claims.

What is claimed is:

1. A device designed to be positioned along an individual's back which is useful for training an individual to maintain a substantially straight torso during a golf swing, said device, comprising:

a substantially rigid elongated support member including first and second partially overlapping panels which are selectively adjustable lengthwise relative to each other to accommodate individuals of varying height, said support member having a first end disposed along the individual's upper back, a second end disposed along the individual's lower back, a body portion extending between said first and second ends, and a comfort pad disposed along the inner surface of said support member at both said first and second ends; and means for attaching the support member along the individual's back, said means comprising a plurality of selectively adjustable resilient straps having interengagable portions extending from the support member including a first set of straps extending from said support member proximate to the first end and a second set of straps extending from said support member proximate the second end, said straps being positioned about the individual's torso upon joining said interengagable portions;

whereby upon attachment of the posturing device such that the support member is disposed contiguously along the length of the individual's back, the individual is able to assure they are maintaining a substantially straight upper body posture.

2. The posturing device of claim 1, wherein said plurality of straps include a third strap disposed proximate a first end of the support member.

3. The posturing device of claim 1, wherein said first and second panels are substantially L-shaped having a first base portion and a second elongated portion which is thinner than said base portion, said elongated portions of the first and second panels being arranged in a partially overlapping manner.

4. The posturing device of claim 1, wherein a decorative covering is disposed over the support member.

5. A device designed to be positioned along an individual's back to assure that they maintain a substantially straight torso during a golf swing, comprising:

a substantially rigid elongated support member including first and second partially overlapping panels which are selectively adjustable lengthwise relative to each other to accommodate individuals of varying height, said support member having a first end positionable along the individual's upper back, a second end positionable along the individual's lower back and a body portion having an inner surface which extends along the length of the individual's back between said upper and lower back portions;

resilient strap means for retaining the support member along the individual's back, said resilient strap means including a first strap means having first and second interengagable portions attached proximate a first end of the support member and second strap means having first and second interengagable portions attached proximate to a second end of the support member, said strap means being positioned about the individual's torso to maintain the support member along the midline of the individual's back; and pad means disposed along the inner surface of the support member, said pad means generally including a first pad disposed along the first end of the support member and a second pad disposed along the second end of the support member;

whereby upon attachment of the posturing device along the individual's back, the individual is able to assure they are maintaining a substantially straight torso while making a golf swing.

6. The posturing device of claim 5, wherein the first and second interengagable portions of the first strap means are attached to said support member along opposite laterally extending edges and said first and second interengagable portions of said second strap means are attached to said support member along opposite laterally extending edges, said first and second portions of both the first and second straps having means for connecting the free ends of said strap means.

7. The posturing device of claim 5, further comprising a third strap means extending from the first end of the support member, said third strap means including a base portion attached to the support member and a bifurcated portion extending from the base portion, said bifurcated portion including means for attachment to at least one of said first or second strap means.

8. The posturing device of claim 5, wherein said first and second panels are substantially L-shaped having a first base portion and a second elongated portion which is thinner than said base portion, said elongated portions of the first and second panels being arranged in a partially overlapping manner.

9. The posturing device of claim 5, wherein a decorative covering is disposed over the support member.

* * * * *